US007067751B2

(12) United States Patent
Nishimura et al.

(10) Patent No.: US 7,067,751 B2
(45) Date of Patent: Jun. 27, 2006

(54) SWITCH

(75) Inventors: Kenji Nishimura, Hirakata (JP); Tamotsu Yamamoto, Ashiya (JP); Tatsuya Tsuda, Obama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/984,842

(22) Filed: Nov. 10, 2004

(65) Prior Publication Data

US 2005/0098422 A1 May 12, 2005

(30) Foreign Application Priority Data

Nov. 11, 2003 (JP) ..... 2003-380885

(51) Int. Cl.
*H01H 9/00* (2006.01)

(52) U.S. Cl. ..... 200/293; 200/559; 200/553

(58) Field of Classification Search .... 200/16 R–16 D, 200/553, 557–563, 293, 302.1, 302.2, 302.3
See application file for complete search history.

(56) References Cited

U.S. PATENT DOCUMENTS

| | | | | |
|---|---|---|---|---|
| 4,771,139 | A * | 9/1988 | DeSmet | 200/5 A |
| 4,794,215 | A * | 12/1988 | Sawada et al. | 200/512 |
| 5,049,707 | A * | 9/1991 | Kameya | 200/16 D |
| 6,222,144 | B1 * | 4/2001 | Nishikawa | 200/537 |
| 6,495,780 | B1 * | 12/2002 | Tucci et al. | 200/302.1 |
| 6,525,285 | B1 | 2/2003 | Kudo et al. | |
| 6,559,401 | B1 * | 5/2003 | Minami et al. | 200/559 |
| 6,633,013 | B1 * | 10/2003 | Nishimura et al. | 200/559 |
| 6,841,751 | B1 * | 1/2005 | Sasaki et al. | 200/553 |
| 6,917,008 | B1 * | 7/2005 | Ni | 200/563 |

* cited by examiner

*Primary Examiner*—Michael A. Friedhofer
(74) *Attorney, Agent, or Firm*—Wenderoth, Lind & Ponack, L.L.P.

(57) ABSTRACT

A switch including an insulative plastic case having a cavity formed therein, a metal cover joined to the case to cover over the cavity, and a switching contact section contained in the cavity. In this switch, a surface of the cover opposed to the case has an insulative film formed on at least a region of the surface facing to the cavity. The switch can prevent externally-originated static electricity from adversely affecting the switching contact section to protect a circuit section of a device connected to the switching contact section.

12 Claims, 7 Drawing Sheets

SWITCH

BACKGROUND OF THE INVENTION

1. Field of the Invention

The present invention relates to a switch to be mounted on various electronic devices, and more particularly to a switch comprising a switching contact section in a cavity formed in an insulative plastic case, and a metal cover covering or overlying the cavity.

2. Description of the Related Art

Recently, in connection with downsizing and weight reduction in various electronic devices, a smaller and thinner switch is preferably used in input operation sections, various detecting mechanisms and other electronic devices. Such a conventional switch will be described with reference to FIGS. 7 to 9. FIG. 7 is a perspective external view showing the conventional switch. FIG. 8 is a top view of the switch after a cover thereof has been removed, and FIG. 9 is a sectional view of the switch including the cover, taken along line II—II in FIG. 8.

The switch is generally formed in an approximately rectangular parallelepiped shape. This switch comprises an insulative plastic case 1 formed with a cavity 14 having an upward opening. The switch also includes a cover 2 formed of a thin metal sheet and joined to the case 1 so as to cover the cavity 14. The case 1 and the cover 2 define a space in the case 1, and a switching contact section is disposed in the inner space.

An operation member 3 includes an operating lever 4 and a main body 5 which are integrally molded as a single piece using resin. As shown in FIG. 8, the operation member 3 is formed with a pair of columnar protrusions 6 extending from the respective opposite sides of the main body 5, and the columnar protrusions 6 are mounted on a support portion 1A of the case 1 to serve as a pivot for allowing the operation member 3 to be rotatably held by the case 1.

The operating lever 4 protrudes obliquely upward from the front region of the case 1. When the operating lever 4 is tiltingly manipulated upward, the entire operation member 3 is rotated about the rotatably held portion described above to switch the state of the switching contact section.

The structure of the switching contact section will be described below. As shown in FIG. 8, a first contact 11 is fixed in an exposed manner to a right inner-wall constituting the cavity 14 of the case 1, and a second contact 12 is fixed in an exposed manner to a rear inner-wall of the cavity 14. The first and second contacts are led outside as a first terminal 11A and a second terminal 12A, respectively.

The reference numeral 15 indicates a movable contact segment formed of a thin metal sheet. The movable contact segment 15 is fixed to the case 1 in such a manner that a reverse C-shaped fixed portion 15 A formed at one end thereof is maintained in contact with the first contact 11.

The movable contact segment 15 has a flat plate portion 15B extending from the fixed portion 15A, and the flat plate portion 15B is resiliently bent at a given position thereof to allow the movable contract segment 15 to be contained in the cavity 14. Thus, a contact portion 15C formed at the other end of the movable contact segment 15 is in contact with the rear inner-wall surface of the case 1 while applying a resilient force of the flat plate portion 15B to the rear inner-wall surface.

FIG. 8 shows a non-operated state of the switch. In this state, the movable contact segment 15 is bent slightly rearward, and the contact portion 15C is stationarily in contact with the rear inner-wall surface of the case 1 at a position apart from the second contact 12.

The rear surface of a drive segment 17 supported by the case 1 rotatably in a horizontal direction relative to the bottom surface of the case 1 is in contact with the front surface of the flat plate portion 15B of the movable contact segment 15, and the front portion of the drive segment 17 is in contact with the main body 5 of the operation member 3, so that a forward biasing force from the movable contact segment 15 is applied to the main body 5 of the operation member 3 through the drive segment 17. This biasing force is applied in a direction allowing the operation member 3 to be rotationally moved and raised upward. When the operation member 3 is applied with the forward biasing force, the bottom surface of a stopper projection 5A formed in the rear region of the main body 5 so as to protrude rearward beyond the columnar protrusions 6 is brought into contact with a step portion 1B of the case 1. Thus, the operation member 3 is stopped at a given angular position.

The conventional switch with the above structure is operated as follows. When the operating lever 4 is pushed downward, the operating lever 4 is tiltingly rotated about the columnar protrusions 6 serving as a pivot. Then, the rear surface of the main body 5 pushes the drive segment 17 rearward, and thereby the drive segment 17 is rotationally moved toward the rear region of the case 1 in a horizontal plane. In proportion to the displacement of the drive segment 17, the front surface of the flat plate portion 15B of the movable contact segment 15 is pushed rearward. Thus, the movable contact segment 15 is resiliently bent or deformed while maintaining the fixed state of the fixed portion 15A, and the contact portion 15C is moved rightward while keeping in contact with the rear inner-wall surface of the case 1. Consequently, the contact portion 15C is brought into contact with the second contact 12 to provide a conductive state between the first contact 11 and the second contact 12, or between the first terminal 11A and the second terminal 12A, through the movable contact segment 15.

When the tilting operation force being applied to the operating lever 4 is released, the movable contact segment 15 is restored to its original shape, and the contact portion 15C is moved away from the second contact 12. Thus, the first contact 11 and the second contact 12 are returned to an electrically independent state.

During this operation, the front surface of the flat plate portion 15B of the movable contact segment 15 pushes the drive segment 17 forward so as to rotationally move the drive segment 17 in the horizontal plane. Thus, the rear surface of the main body 5 of the operation member 3 is pushed forward to its original position. The operation member 3 applied with the above force is rotated about the columnar protrusions 6 in a direction allowing the operating lever 4 to be oriented obliquely upward. Then, when the bottom surface of the stopper projection 5A formed in the main body 5 is brought into contact with the step portion 1B of the case 1, the operation lever 4 is returned to its original position where it is stopped at the angular position in the non-operated state as shown in FIGS. 7 and 8.

An example of prior art related to the invention of this application includes Japanese Unexamined Patent Publication No. 2001-184994.

In use, the above conventional switch is mounted on various electronic devices, and connected to a circuit section in a wiring board thereof. While this switch can release static electricity entering from outside through the metal thin-plate cover 2 to a grounding portion of the circuit section, there is an increasing need for developing further improved countermeasures against static electricity, from the standpoint of electronic devices using such a switch.

SUMMARY OF THE INVENTION

In view of the above circumstances, it is therefore an object of the present invention to provide a switch incorporating a countermeasure against static electricity so as to prevent externally-originated static electricity from adversely affecting a switching contact section.

In order to achieve the above object, the present invention provides a switch comprising an insulative plastic case having a cavity formed therein, a metal cover joined to the case to cover over the cavity, and a switching contact section contained in the cavity. In this switch, a surface of the cover opposed to the case is formed with an insulative film.

According to the present invention, even if static electricity enters from outside into the cover, the static electricity can be released outside through the metal cover. In addition, the insulative film disposed between the metal portion of the cover and the switching contact section can provide an enhanced insulation performance to prevent the static electricity from being discharged to the switching contact section. Furthermore, a signal line in a circuit section of a device connected to the switching section also can be effectively protected.

In the switch of the present invention, the cover may have a leg portion adapted to be disposed adjacent to or soldered to a ground section of a wiring board which is provided in a device to be connected to the switching contact section. This switch can reliably release static electricity to the ground section of the wiring board.

Further, the leg portion may have a shape capable of holding the case. This switch can provide an enhanced connection between the case and the cover, and a shape having a reduced projected area, in conformity with the need for downsizing of a switch.

Specifically, the leg portion may have a shape including a bended region extending along the sidewall to the bottom of the case. This makes it possible to bring the cover into close contact with the case so as to provide enhanced dust resistance.

In the switch having the leg portion, the insulative film may further be formed on the leg portion to provide further enhanced insulation performance.

The switch with the leg portion may include a terminal provided at one side of the sidewall of the case, and the leg portion may be disposed on the other side of the sidewall. This switch makes it possible to facilitate the connection between the terminal and the wiring board, and reliably prevent the contact between the leg portion of the cover and the terminal.

The leg portion may have a shape partly including a protruded region to facilitate an operation of soldering the leg portion or arranging the leg portion at a position adjacent to the ground section.

The case may have a sidewall formed with a projection, and the leg portion may have a shape extending along the sidewall of the case. The leg portion may also be formed with an engagement hole engageable with the projection. According to this structure, the cover can be readily joined to the case by engaging the engagement hole of the leg portion with the projection of the case. Thus, an assembling operation for the cover can be facilitated. This structure also allows the cover to be brought into close contact with the case so as to provide enhanced dust resistance.

The insulative film may be formed on the entire surface of the cover opposed to the case to provide further enhanced insulation performance.

The insulative film may be made of either one of nylon 66 and fluororesin to provide a reduced thickness and enhanced adhesion of the film. Further, this film is excellent in environment resistance and chemical resistance.

Further, the insulative film may have a thickness ranging from 3 μm to 20 μM. The film with a thickness of 3 μm or more can have an adequate insulation performance. The film with a thickness of 20 μm or less can be prepared through a stable film forming procedure. In the film having the leg portion formed with the insulative film, the insulative film may have a thickness of 20 μm or less to prevent deterioration in workability for bending the leg portion.

As above, according to the present invention, the insulative film is formed on the metal cover so as to provide an enhanced insulation performance between the switching contact section and the cover, and release externally-originated static electricity outside through the metal cover. Thus, the present invention can advantageously provide a switch incorporating a countermeasure against static electricity, thereby being capable of preventing the static electricity from adversely affecting the switching contact section to protect a circuit section of a device connected to the switching contact section.

Other features and advantages of the present invention will be apparent from the accompanying drawings and from the detailed description.

DETAILED DESCRIPTION OF THE PREFERRED EMBODIMENTS

Figure 1:
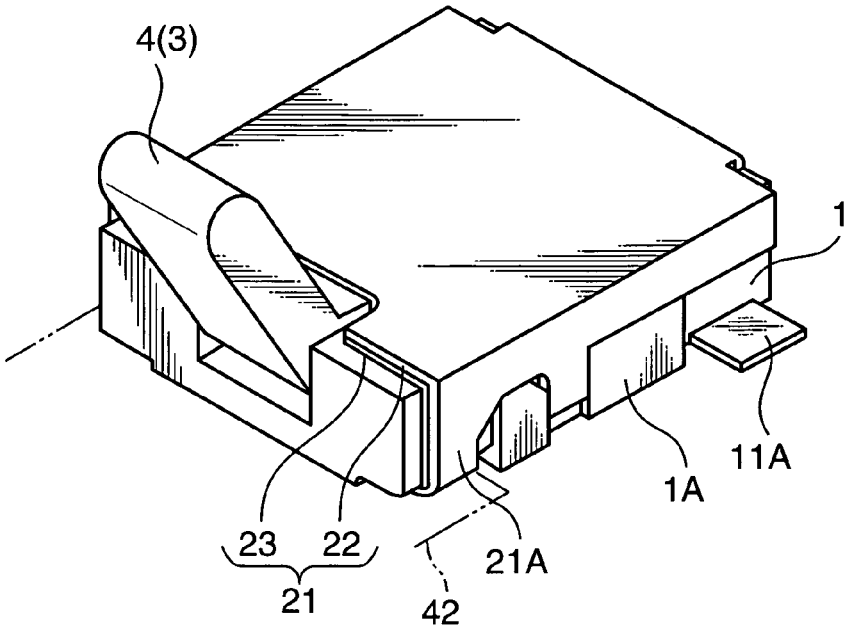
FIG. 1 is a perspective external view of a switch according to a first embodiment of the present invention.

With reference to FIGS. 1 to 6, an embodiment of the present invention will now be described. In these figures, the same components or elements as described in the foregoing "DESCRIPTION OF THE BACKGROUND ART" is defined by the same reference numerals, and their description will be simplified.

FIRST EMBODIMENT

Figure 2:
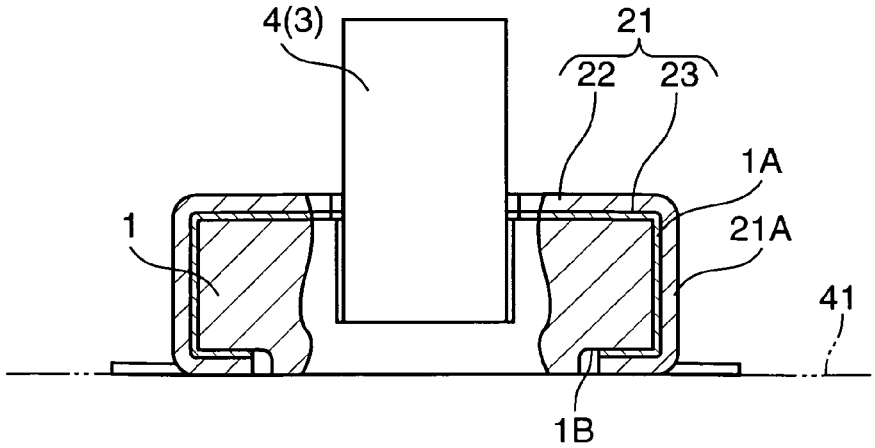
FIG. 2 is a partially sectional front view of the switch according to the first embodiment.
Figure 3:
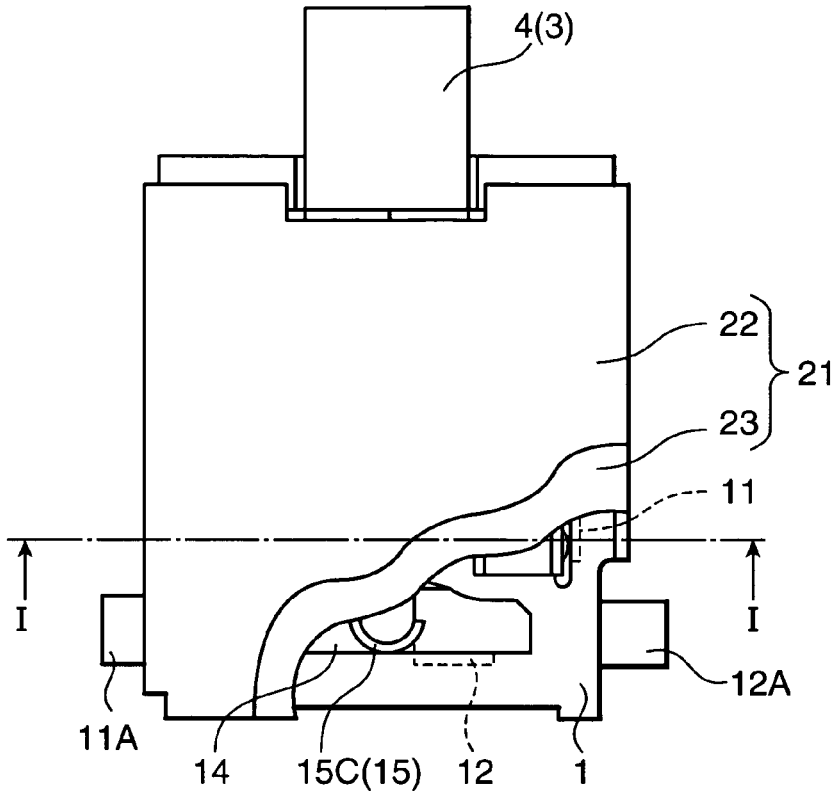
FIG. 3 is a top view of the switch according to the first embodiment, wherein a cover of the switch is partly cut away.
Figure 4:
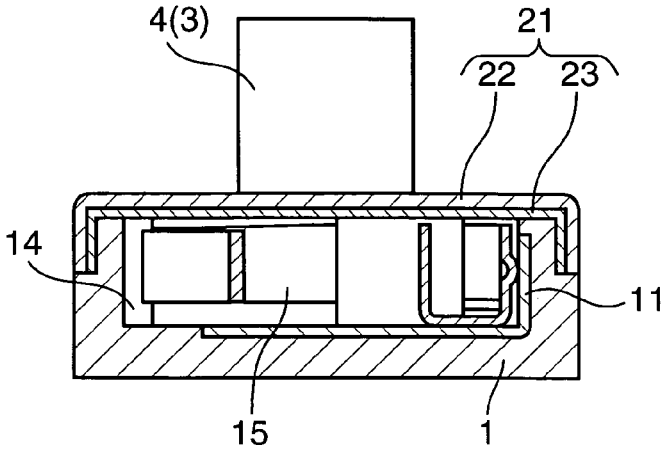
FIG. 4 is a sectional view of the switch including the cover, taken along line I—I in FIG. 3.

FIG. 1 is a perspective external view showing a switch according to a first embodiment of the present invention, and FIG. 2 is a partially sectional front view of the switch. FIG. 3 is a top view of the switch, wherein a cover of the switch is partly cut away. FIG. 4 is a sectional view of the switch including the cover, taken along the line I—I in FIG. 3.

The switch according to the first embodiment comprises a case 1 made of an insulative resin material. As shown in FIGS. 3 and 4, the case 1 is formed with a cavity 14 having an upward opening in the upper side thereof, as with the conventional switch. This cavity 14 contains a switching contact section having the same structure as that of the conventional switch. The cavity 14 is covered by a cover 21 joined to the case 1.

In the first embodiment, the respective structures of the case 1 and the switching contact section are the same as those of the conventional switch (as previously discussed in the Description of Related Art), and thus their detailed illustration and description will be omitted.

In the switch according to the first embodiment, the cover 21 has a different structure from that of the cover of the conventional switch, and a countermeasure against static electricity is developed based on the cover 21.

Specifically, as shown in FIG. 3, the cover 21 comprises a base member 22 formed of a thin metal plate, and an insulative film 23 integrally formed on the entire inner (bottom) surface of the base member 22 on the side of the switching contact section.

The cover 21 is arranged such that the insulative film 23 covers the entire cavity 14 including the top end portion of the sidewall of the cavity 14. Thus, after completion of an assembling operation for the switch, the base member 22 is never exposed to the switching contact section.

While the insulative film 23 is not limited to a specific material, any suitable material having an insulation performance may be used, but it is preferably made of a material capable of providing a reduced film thickness, excellent adhesion with the base member, and excellent environment and chemical resistance, such as nylon 66 or fluororesin.

Preferably, the insulative film 23 is formed to have a thickness ranging from 3 μm to 20 μm.

The integral or single-piece structure of the insulative film 23 and the base member 22 makes it possible to suppress the occurrence of scratches or flaws in the insulative film 23 during the assembling operation and facilitate automatization of the assembling operation. Thus, the switch of the present invention is preferably applied particularly to a smaller, thinner version of a detection switch.

As shown in FIGS. 1 and 2, the cover 21 has a pair of leg portions 21A disposed at opposite sides of a front portion of the cover 21. Each of the leg portions 21A extends downward from a corresponding one of the opposite ends of the top surface of the cover 21, and has a shape including a bended region capable of wrapping around the range of the sidewall 1A to the bottom of the case 1 from outside. The cover 21 is joined to the case 1 in such a manner that the leg portions 21A clamp the case 1 from both sides thereof.

Before the cover 21 is attached to the case 1, each of the leg portions 21A of the cover 21 has a shape extending straight downward from the top surface of the cover 21. Then, after the cover 21 is attached to the case 1, the lower end of each of the leg portions 21A is bent in such a manner as to extend along the bottom 1B of the case 1. Through this operation, each of the leg portions 21A can have the aforementioned bended shape extending along the profile of the case 1.

The insulative film 23 is also formed on the respective inner surfaces of the leg portions 21A of the base member 22 in an integral manner.

The leg portion 21A is designed such that the lower end of the leg portion can be connected to a ground section 42 provided in a wiring board 41 of an associated device to be operated by the switch, through a soldering operation or the like.

Both first and second terminals 11A, 12A are provided in the rear side region of the sidewall 1A of the case 1. That is, the terminals 11A, 12A are disposed at one (rear end) of the ends of the sidewall 1A of the case 1, and the leg portions 21A of the cover 21 are disposed at the other end (front end) of the sidewall 1A. Further, both the terminals 11A, 12A are disposed at the bottom of the sidewall 1A so that they are not in contact with the cover 21. The first terminal 11A and the second terminal 12A are connected to the wiring board 41 of the associated device.

According to the first embodiment of the switch as described above, an operating lever 4 of an operation member 3 is tiltingly operated to move a drive segment (not shown) contained in the cavity 14. One of the ends of a movable contact segment 15 (fixed portion 15A) remains continuously in contact with a first contact 11. The other end (contact portion 15*c*) is moved by the drive segment so as to allow the contact portion 15C of the movable contact segment 15 to be brought into contact with or separated from a second contact 12 to perform a switching operation, as with the conventional switch.

Further, in the switch according to the first embodiment, the leg portions 21A of the cover 21 can be connected to the ground section provided in the wiring board 41 of the associated device. Thus, when static electricity enters from outside into the cover 21, the static electricity can be released from the base member 22 made of a thin metal plate to the ground section 42 through the leg portions 21A. Moreover, in the cover 21, the insulative film 23, which is integrally formed on and tightly bonded to the entire inner surface of the base member 22 on the side of the switching contact section, allows the insulation between the switching contact section and the base member 22 of the cover 21 to be maintained at a high level. Thus, static electricity entering the cover 21 is never discharged from the base member 22 to the switching contact section. This can prevent the static electricity from entering into a signal line in the circuit section of the associated device connected to the switching contact section in order to protect the circuit section.

Furthermore, the switch according to the first embodiment can obtain the above effects only by modifying the cover 21. Thus, existing facilities and other components can be commonly used without introducing new facilities or the like to produce the switch while minimizing the increase in cost.

In the first embodiment, the bottom of the case 1 is held by the leg portions 21A as shown in FIG. 2. Thus, the contact between the insulative film 23 and the top end portion of the sidewall of the case 1 can be increased to a high level to provide enhanced dust resistance. In addition, the lower side surface of each of the leg potions 21A can be readily attached to the wiring board 41 of the associated device through a soldering operation or the like. Thus, the switch can have a reduced projected area with excellent attachability.

Further, in the first embodiment, the terminals 11A, 12A are disposed at the rear end of the sidewall 1A, and the leg portions 21A are disposed on the front side of the sidewall 1A. Thus, the connection between the terminals 11A, 12A and the wiring board 41 can be facilitated while reliably preventing contact between the leg portions 21A of the cover 21 and the terminals 11A, 12A.

Furthermore, in the first embodiment, the insulative film 23 is formed so as to have a thickness ranging from 3 μm to 20 μm. Thus, the film can be stably formed, and an adequate insulation performance can be assured without deterioration in workability for bending the leg portions 21A.

The present invention is intended to provide an enhanced insulation performance in a metal cover covering a switching contact section by integrally forming an insulative film on a surface of a base member on the side of the switching contact section by interposing the insulative film between the base member and the switching contact section. Thus, the application of the present invention is not limited to a switch having a specific structure in a switching contact section and/or a specific operational mode as in the first embodiment, but may be applied to any other switch and electronic components. Further, the leg portions 21A of the cover 21 may have any suitable shape other than those in the first embodiment.

SECOND EMBODIMENT

Figure 5:
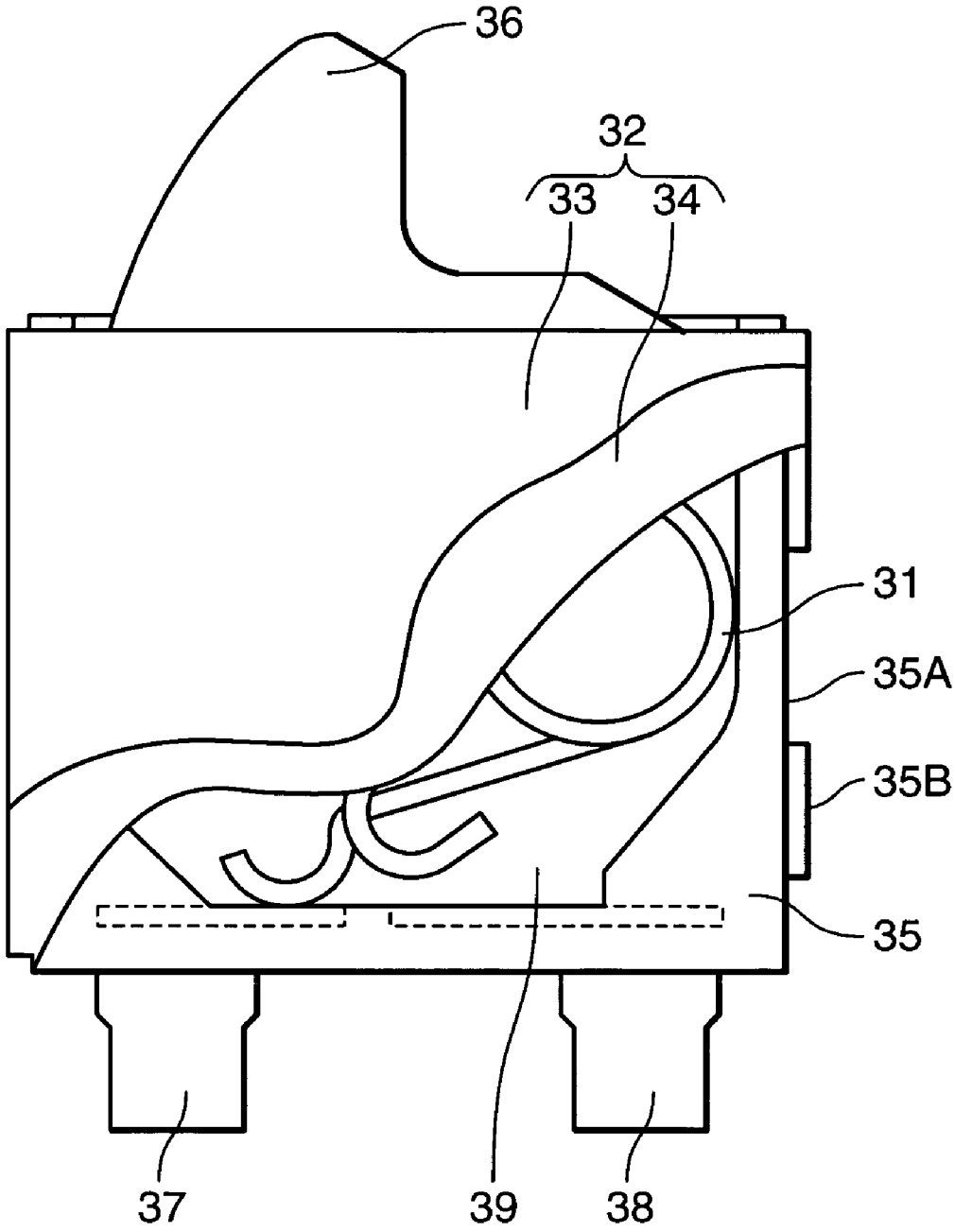
FIG. 5 is a top view showing a switch according to a second embodiment of the present invention, wherein a cover of the switch is partly cut away.
Figure 6:
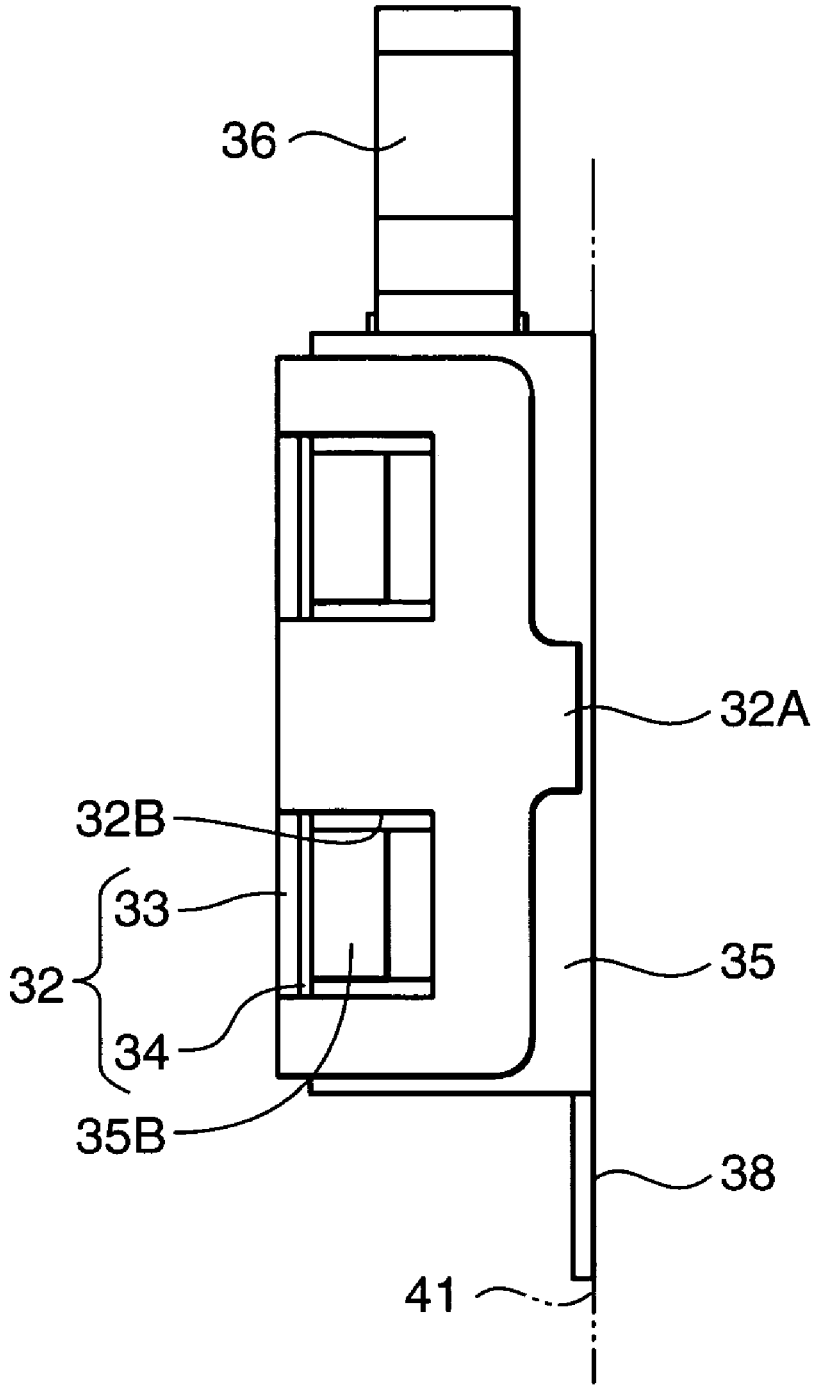
FIG. 6 is a side view of the switch according to the second embodiment.
Figure 7:
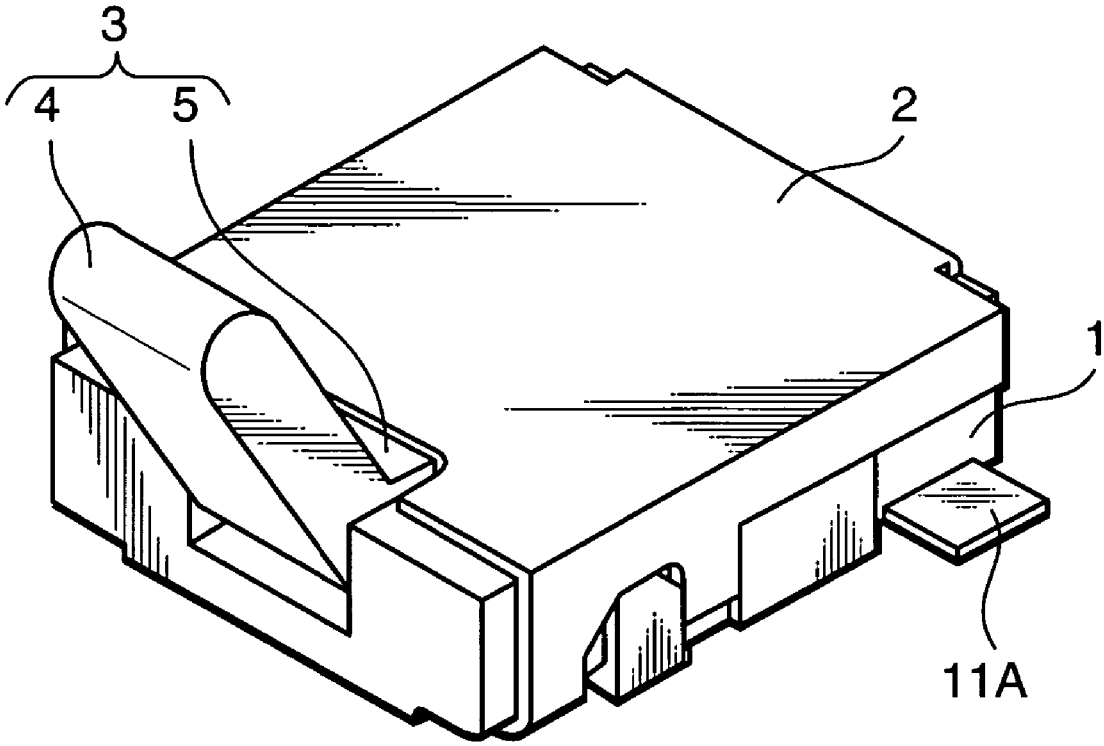
PRIOR ART FIG. 7
FIG. 7 is a perspective external view of a conventional switch.
Figure 8:
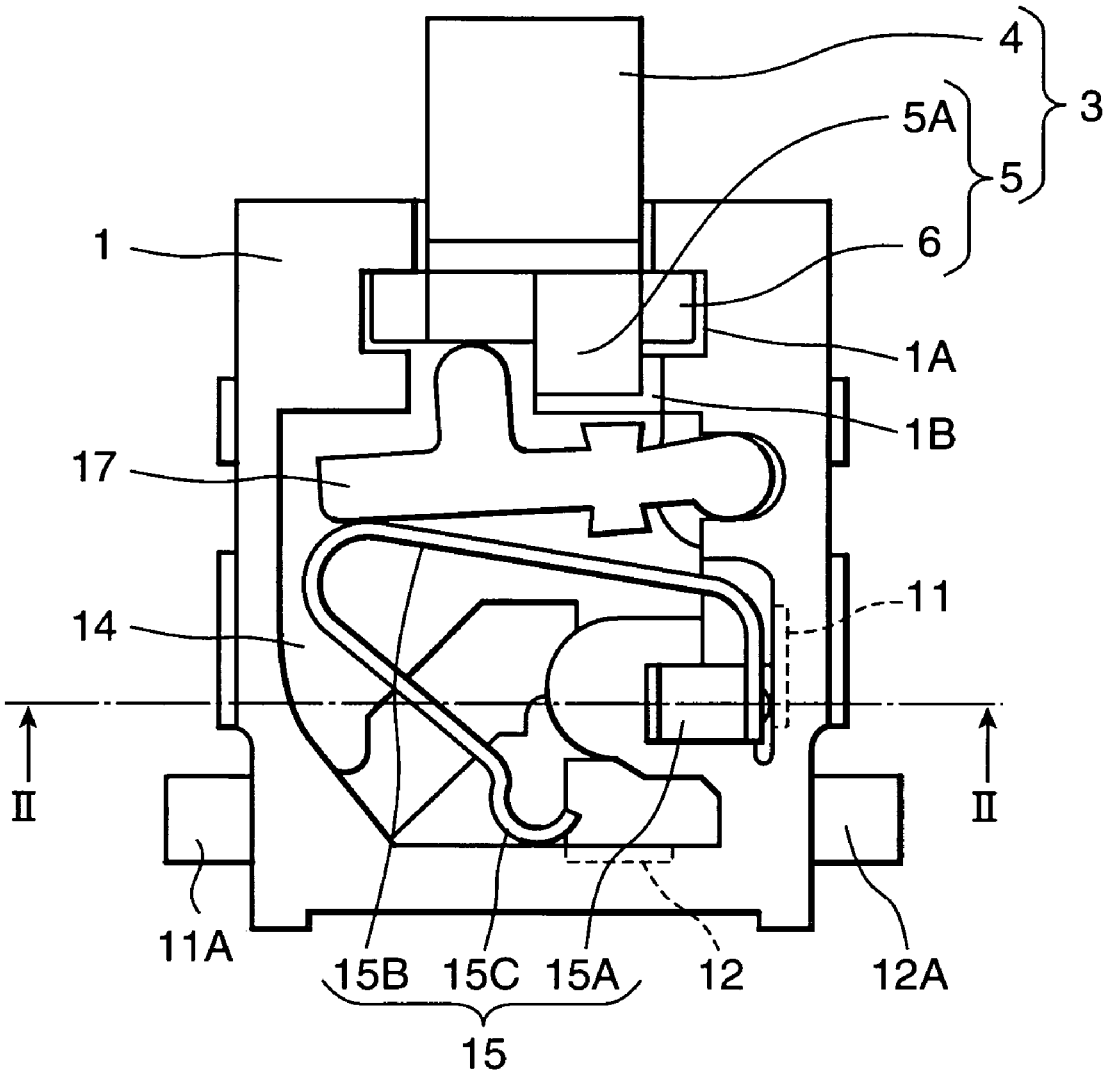
PRIOR ART FIG. 8
FIG. 8 is a top view of the conventional switch after a cover of the switch has been removed.
Figure 9:
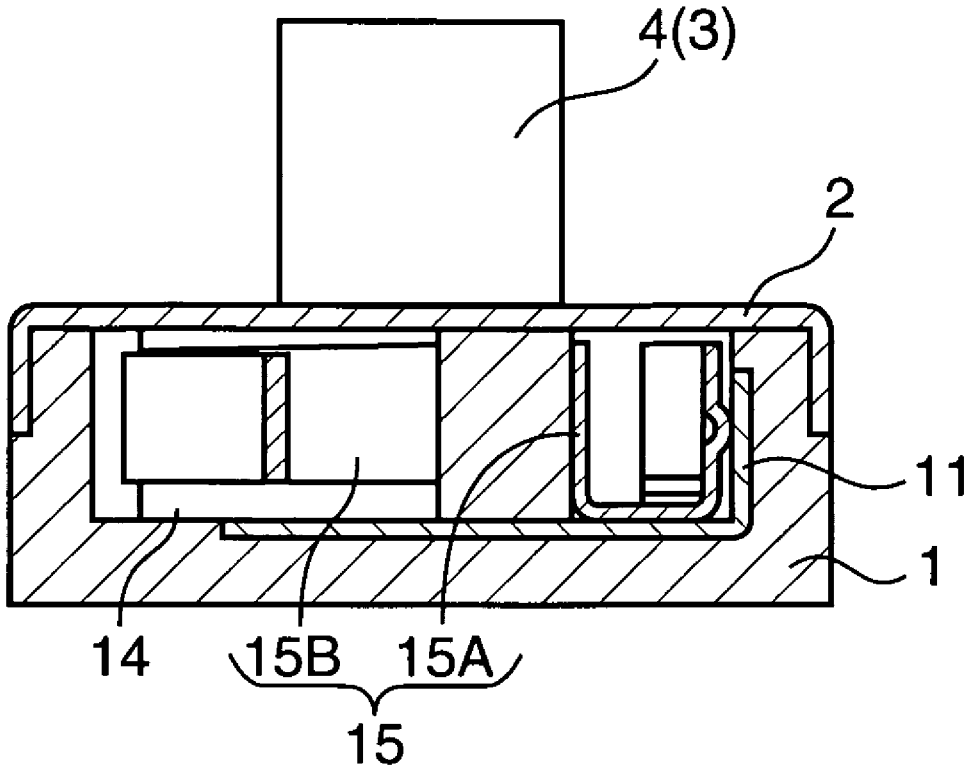
PRIOR ART FIG. 9
FIG. 9 is a sectional view of the conventional switch including the cover, taken along line II—II in FIG. 8.

For example, the present invention can be applied to a push-type switch. As shown in FIGS. 5 and 6, in this switch, a movable contact segment 31 is composed of a coil spring, and an operation member 36 is pushed to provide the conduction between terminals 37, 38. A switching contact section composed of the movable contact section 31 or the like is contained in a cavity 39 of a case 35. A cover 32 is provided on the case 35 to cover the cavity 39. The cover 32 comprises a base member 33 formed of a thin metal plate, and an insulative film 34 formed on the bottom surface of the base member 33. The base member 33 and the insulation film 34 are integrally formed in a single piece, and can provide the same effects as those of the cover in the first embodiment.

As shown in FIG. 6, a leg portion 32A provided in the cover 32 has a shape extending downward along the sidewall 35A of the case 35. Differently from the first embodiment, the lower end of the leg portion 32A is located adjacent to the bottom of the sidewall 35A of the case 35, and at a region between the upper end and the bottom end of the sidewall 35A. That is, the leg portion 32A is not formed to wrap around the range of the sidewall 35A to the bottom of the case 35.

A projection 35B is provided in the sidewall 35A of the case 35, and an engagement hole 32B engageable with the projection 35B is formed in the leg portion 32A. The upper region of the projection 35B is formed so as to have an inclined surface. The projection 35B also has a lower surface approximately perpendicular to the sidewall 35A of the case 35. Thus, in an operation of attaching the cover 32 to the case 35, the cover 32 can be simply fitted to the case 35 from above to complete the attaching operation smoothly without difficulties, and the projection 35B can be brought into engagement with the engagement hole 32B of the cover 32 to reliably attach the cover 32 to the case 35. In addition, the cover 32 can be brought into close contact with the case 35 to provide enhanced dust resistance.

The leg portion 32A is formed to have a shape that protrudes downward at the central region of the sidewall. This shape allows the leg portion 32A to be readily arranged adjacent to a ground section 42 of a wiring board 41.

Thus, the switch may be mounted at a position allowing the leg portion 32A to be located opposed and adjacent to the ground section 42 of the wiring board 41 with a slight gap therebetween so as to release static electricity to the ground section 42.

In the second embodiment, the leg portion 32A is preferably fixed through a soldering operation to provide enhanced mechanical strength.

As with the first embodiment, the leg portion 32A, in a push-type switch, may have a shape with a bended region extending along the sidewall and the bottom of the case 35.

As mentioned above, the switch according to the second embodiment of present invention can prevent an externally-originated static electricity from entering into the switching contact section, and thereby prevent the static electricity from adversely affecting a circuit section of an associated device.

While the description regarding other structure, operation and effect will be omitted, these are the same as those in the first embodiment.

This application is based on Japanese patent application serial No. 2003-380885, filed in Japan Patent Office on Nov. 11, 2003, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A switch comprising:

an insulative plastic case having a cavity formed therein;

a switching contact section contained in said cavity; and a cover joined to said case to cover said cavity said cover including:

a base member formed of a thin metal plate, said base member having a top surface and at least one leg portion which extends downward from the top surface; and an insulative film integrally formed on at least a surface of said base member that is opposed to said cavity and on a surface of said leg portion opposed to said case, wherein said insulative film has a thickness ranging from 3 μm to 20 μm.

2. The switch as defined in claim 1, wherein said leg portion is adapted to be soldered to a grounding section of a wiring board which is provided in a device to be connected to said switching contact section.

3. The switch as defined in claim 1, wherein said leg portion has a shape capable of holding said cover on said case.

4. The switch as defined in claim 3, wherein said leg portion has a shape including a bended region extending along a sidewall of said case and extending along at least a portion of a surface of said case opposite the surface of said case that includes said cavity.

5. The switch as defined in claim 1, which includes a terminal provided at one side of the sidewall of said case, wherein said leg portion is disposed on the other side of said sidewall.

6. The switch as defined in claim 1, wherein said leg portion is adapted to be disposed adjacent to a grounding section of a wiring board which is provided in a device to be connected to said switching contact section.

7. The switch as defined in claim 6, further comprising a terminal provided at one side of said sidewall of said case, wherein said leg portion is disposed on the other side of said sidewall.

8. The switch as defined in claim 6, wherein said leg portion includes a protruded region.

9. The switch as defined in claim 5, wherein said case has a sidewall formed with a projection, and said leg portion extends along said sidewall of said case, said leg portion being formed with an engagement hole engageable with said projection.

10. The switch as defined in claim 1, wherein said insulative film is formed on the entire surface of said base member opposed to said case.

11. The switch as defined in claim 1, wherein said insulative film is made of either one of nylon 66 and fluororesin.

12. The switch as defined in claim 1, wherein said base member is solid across the entire surface of said base member that is opposed to said cavity.

* * * * *